US007117846B1

(12) United States Patent
Yoshida

(10) Patent No.: US 7,117,846 B1
(45) Date of Patent: Oct. 10, 2006

(54) THROTTLE CONTROL APPARATUS

(75) Inventor: Hidefumi Yoshida, Kanagawa (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/283,809

(22) Filed: Nov. 22, 2005

(51) Int. Cl.
*F02D 9/10* (2006.01)
*F02N 17/00* (2006.01)

(52) U.S. Cl. ..... 123/339.13; 123/178.18

(58) Field of Classification Search ..... 123/339.1, 123/339.13, 178.18; 74/500.5, 501.5 R, 74/501.6
See application file for complete search history.

(56) References Cited

U.S. PATENT DOCUMENTS 4,401,074 A * 8/1983 Horiuchi et al. ..... 123/339.13
6,003,402 A * 12/1999 Lichtenberg ..... 74/501.6
6,202,626 B1 * 3/2001 Ito et al. ..... 123/336
6,694,937 B1 * 2/2004 Okuma et al. ..... 123/179.18
2004/0094123 A1 * 5/2004 Takahashi et al. ..... 123/399

* cited by examiner

*Primary Examiner*—Stephen K. Cronin
*Assistant Examiner*—Arnold Castro
(74) *Attorney, Agent, or Firm*—Bacon & Thomas

(57) ABSTRACT

To avoid interference of control wires and make a throttle control apparatus to be compact, the apparatus is structured such that a drive lever is mounted on one end of a throttle valve shaft protruding from one side outer wall of the throttle body and connected to a throttle lever, a throttle opening sensor is mounted on another end of the throttle valve shaft protruding from another side outer wall, a bypass air control apparatus having a bypass air passage and an air valve is provided on the other side wall, accelerator wires connected to the throttle lever and initial operation wire connected to the air valve are arranged at opposite sides of the intake passage respectively, so that the operating directions thereof are substantially the same to one another.

1 Claim, 5 Drawing Sheets

THROTTLE CONTROL APPARATUS

BACKGROUND OF THE INVENTION

1. Field of the Invention

The present invention relates to a throttle body which controls air flow supplied to an engine in the fuel injection apparatus, and more particularly relates to a throttle control apparatus used for a motorcycle.

2. Description of the Conventional Art

A conventional throttle body will be described hereinafter with reference to FIGS. 4 and 5 in which FIG. 4 is a longitudinal section of the throttle body and FIG. 5 is a right side view of FIG. 4.

In the figures, the reference numeral 10 indicates a throttle body having an intake passage 11 extending through laterally therein. A throttle valve shaft 12 is provided, across the intake passage 11, and both ends of the throttle valve shaft 12 are rotatably supported on the throttle body 10.

Also, a throttle valve 13 is provided in the intake passage 11 for opening or closing of the intake passage 11. The throttle valve 13 is mounted on the throttle valve shaft 12 so as to open or close the intake passage 11 in accordance with the rotation of the throttle valve shaft 12.

One end 12*a* of the throttle valve shaft 12 is protruded rightward from one side outer wall 10*a* of the throttle body 10 (right side as shown in FIG. 4), and a drive lever 14 is mounted integrally with the one end 12*a*.

The reference numeral 15 indicates a rotary shaft provided uprightly on the one side outer wall 10*a* of the of the throttle body 10. A throttle lever 16 is fixed to the rotary shaft 15 by means of a screw nut.

As shown in FIG. 5, the throttle lever 16 is provided with a first retention hole 16*a* and a second retention hole 16*b*. An end 17*b*, which is attached to one end of the accelerator wire 17*a* to make the throttle valve 13 open, is inserted to the first retention hole 16*a* and engaged therein, while an end 17*d*, which is attached to one end of the accelerator wire 17*c* to make the throttle valve 13 close, is inserted to the second retention hole 16*b* and engaged therein.

Other ends of the accelerator wires 17*a* and 17*c* are connected to the acceleration grips (not shown) respectively. When the acceleration grip is rotated by a driver, this rotation is transmitted to the throttle lever 16 through the ends 17*b* and 17*d* of the accelerator wires 17*a* and 17*c*, respectively, to rotate the throttle lever 16.

The reference numeral 18 indicates a link lever which connects the throttle lever 16 and the drive lever 14. The rotation of the throttle lever 16 is transmitted to the drive lever 14 through the link lever 18. Due to the arrangement where the throttle lever 16 and the drive lever 14 are connected by means of the link lever 18, the rotation of the acceleration grip and the opening characteristic of the throttle valve 13 are made nonlinear.

The reference numeral 19 indicates a throttle opening sensor attached to another end 12*b* of the throttle valve shaft 12 which protrudes from the other side outer wall 10*b* of the throttle body 10. The output signal from the opening sensor 19 is inputted to ECU (not shown) and is used for the various control.

When the acceleration grip (not shown) is rotated in one direction, a wire 17*a* to open the throttle valve 13 rotates the throttle lever 16 in a counterclockwise direction in FIG. 5. By this rotation, the drive lever 14 is rotated through link lever 18, resulting in the opening of the intake passage 11 by the throttle valve 13.

On the other hand, when the acceleration grip (not shown) is rotated in the other direction, a wire 17*c* to close the throttle valve 13 rotates the throttle lever 16 in a clockwise direction in FIG. 5. By this rotation, the drive lever 14 is rotated through link lever 18, resulting in the closing of the intake passage 11 by the throttle valve 13.

In the conventional throttle body, control of idling air flow rate at the time of idling of engine and/or control of initial air flow rate at the time of starting of engine are carried out by a bypass air control apparatus which comprises a bypass air passage that by-passes the throttle valve, and an air valve for controlling the opening area of the bypass air passage.

Generally, in the throttle body used for a motorcycle, the air valve is remote operated by a initial operation wire which is connected to a start lever. The start lever is arranged in the neighborhood of the acceleration grip and is operated by the driver. Two kinds of wires are arranged around the throttle body, i.e. two accelerator wires and one initial operation wire.

In the conventional throttle body used for the motorcycle, there are problems that the two kinds of wires should be arranged without interfering one another, and the bypass air control apparatus should be arranged in close vicinity to the peripheral wall of the throttle body in order to make the throttle body compact.

SUMMARY OF THE INVENTION

The throttle control apparatus for a motorcycle in accordance with the present invention is made taking the above mentioned problems into consideration.

A primary object of the present invention is to provide a throttle control apparatus with a compact throttle body inclusive of an air control apparatus.

A further object of the present invention is to provide a throttle control apparatus wherein an initial operation wire to operate an air valve and accelerator wires to operate a throttle valve lever are arranged without interfering one another around the throttle body.

A still further object of the present invention is to provide a throttle control apparatus for the motorcycle which is easy to be built-in to a motorcycle and is excellent in location and operability of the control wires.

The above objects can be attained by providing a throttle control apparatus for a motorcycle comprising a throttle body having an intake passage extending through therein, a throttle valve shaft supported rotatably in the throttle body across the intake passage, a throttle valve mounted on the throttle valve shaft for opening or closing the intake passage, a drive lever mounted on one end of the throttle valve shaft, a throttle opening sensor mounted on another end of the throttle shaft, the one end of the throttle valve shaft being protruded from one side outer wall of the throttle body, while the other end of the throttle shaft being protruded from another side outer wall of the throttle valve body, the rotation of a throttle lever operated with accelerator wires being transmitted to the drive lever through a link lever, wherein a bypass air passage is provided on the other side outer wall of the throttle body so as to detour the throttle valve to make the intake passage communicate, an air valve is provided in the bypass air passage so as to open or close the bypass air passage by the operation of an initial operation wire, and the accelerator wires and the initial operation wire are arranged at opposite sides of the intake passage respectively, so that the operating directions thereof are substantially the same to one another.

According to the present invention, when the throttle valve lever is rotated in one direction by a operation of acceleration grip to draw the accelerator wire for the valve opening, the drive lever is rotated in one direction by means of the link lever to open the air passage in response to the movement of the acceleration grip.

On the other hand, when the throttle lever is rotated in another direction by the operation of acceleration grip to draw the accelerator wire for the closing of the throttle valve, the drive lever is rotated in another direction by means of the link lever to close the air passage in response to the movement of the acceleration grip.

Further, when an initial operation wire is drawn by the operator, the bypass air passage is opened and retained by the air valve, thereby a desired rate of air flow is supplied from the bypass air passage to the intake passage.

According to the present invention, the accelerator wires retained to the throttle lever are arranged along the one side outer wall of the throttle body, while the initial operation wire is arranged along the other side outer wall of the throttle body.

The accelerator wires and initial operation wire are arranged so that the wires are drawn in substantially the same directions. That is to say, the accelerator wires and initial operation wire are arranged so that the locational and operational directions thereof are substantially the same to one another, at opposite sides of the intake passage.

With such structure, the accelerator wires and initial operation wire are not brought to be intersected and interfered with one another along the way, and location and operability of the wires may be improved, especially in a motorcycle where a space to receive the throttle body is limited to be narrow.

Further, due to the arrangement where the accelerator wires and initial operating wire are drawn in substantially the same directions, workability for connecting the accelerator wires and the throttle lever can be improved and workability for connecting the initial operation wire and the air valve can also be improved.

Furthermore, according to the present invention, since the bypass air passage including the air valve and the throttle opening sensor are disposed on the same other side outer wall of the throttle body, and only the throttle opening sensor in a small shape is an interfering member there, the bypass air control apparatus can be arranged in close vicinity to the throttle body, thereby a compact throttle control apparatus can be provided.

DETAILED DESCRIPTION OF PREFERRED EMBODIMENTS

Figure 1:
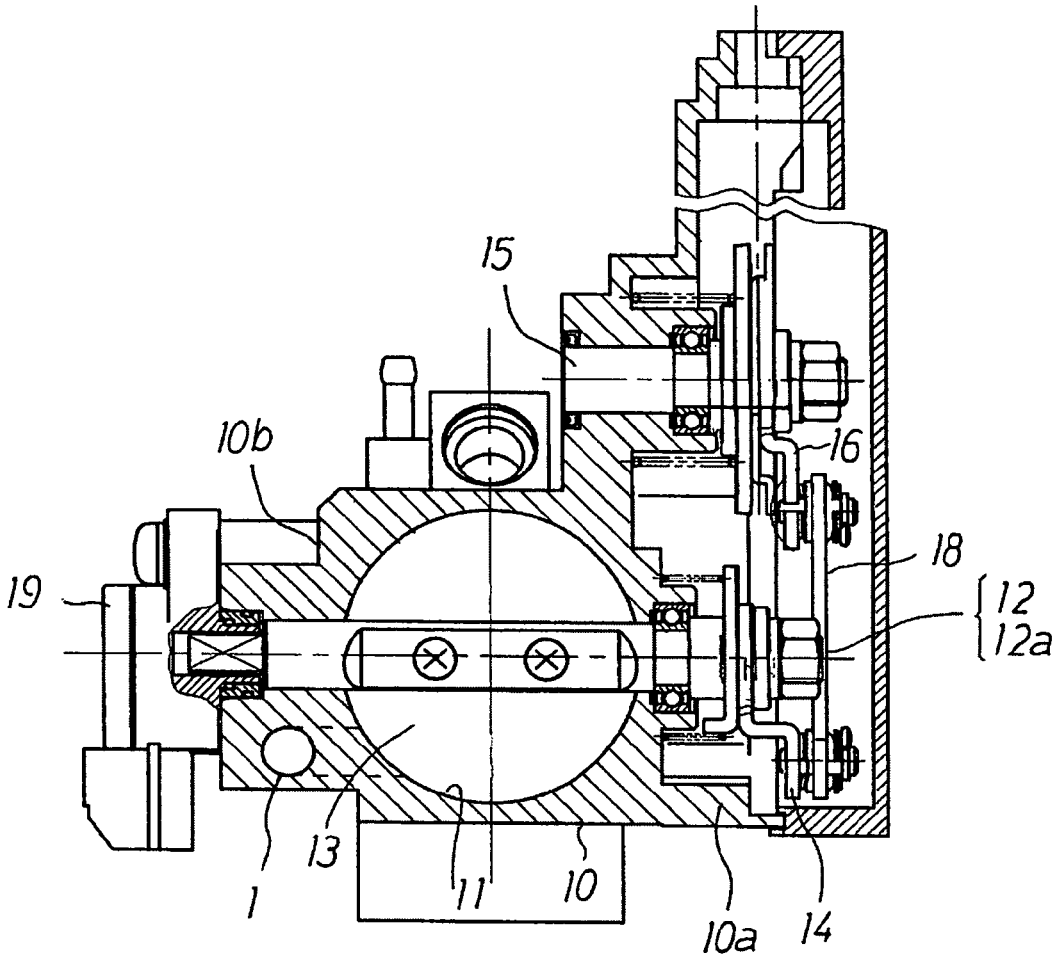
FIG. 1 is a longitudinal section showing an embodiment of the throttle control apparatus for a motorcycle according to the present invention.
Figure 2:
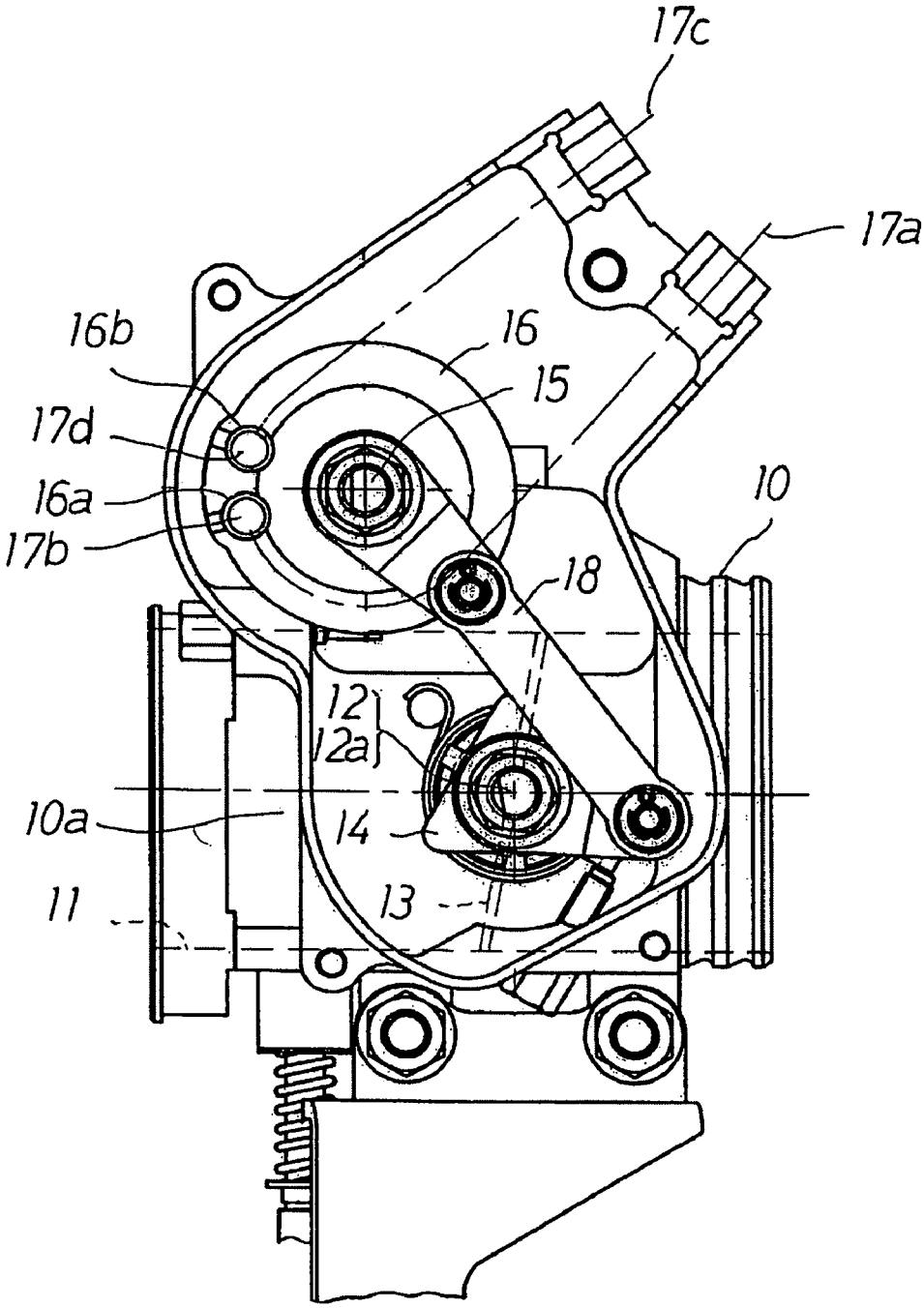
FIG. 2 is a right side view of FIG. 1.

The throttle control apparatus for a motorcycle according to the present invention will now be described by way of an example with reference to FIG. 1 to FIG. 3.

Figure 4:
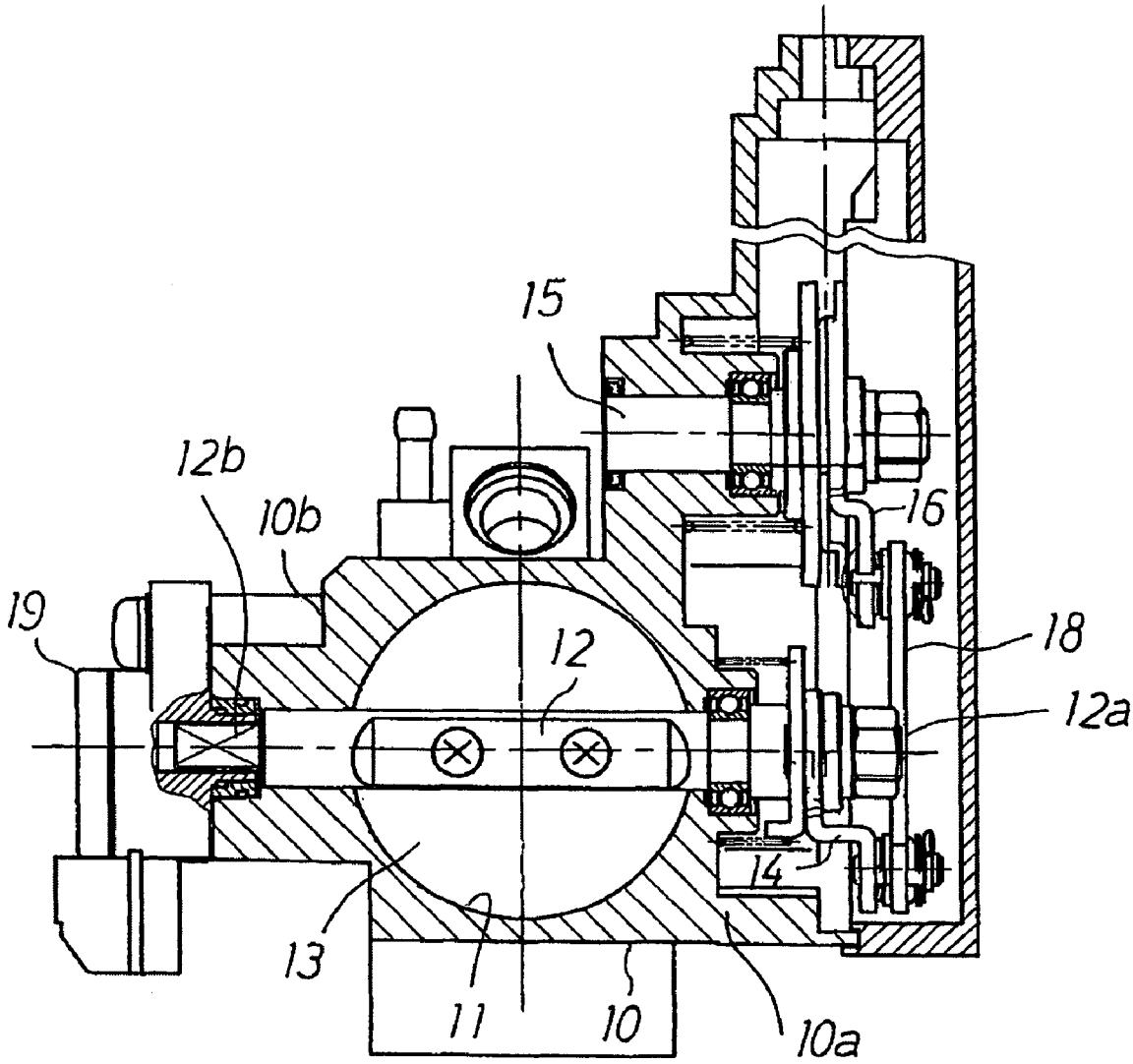
FIG. 4 is a longitudinal section showing a conventional throttle control apparatus.
Figure 5:
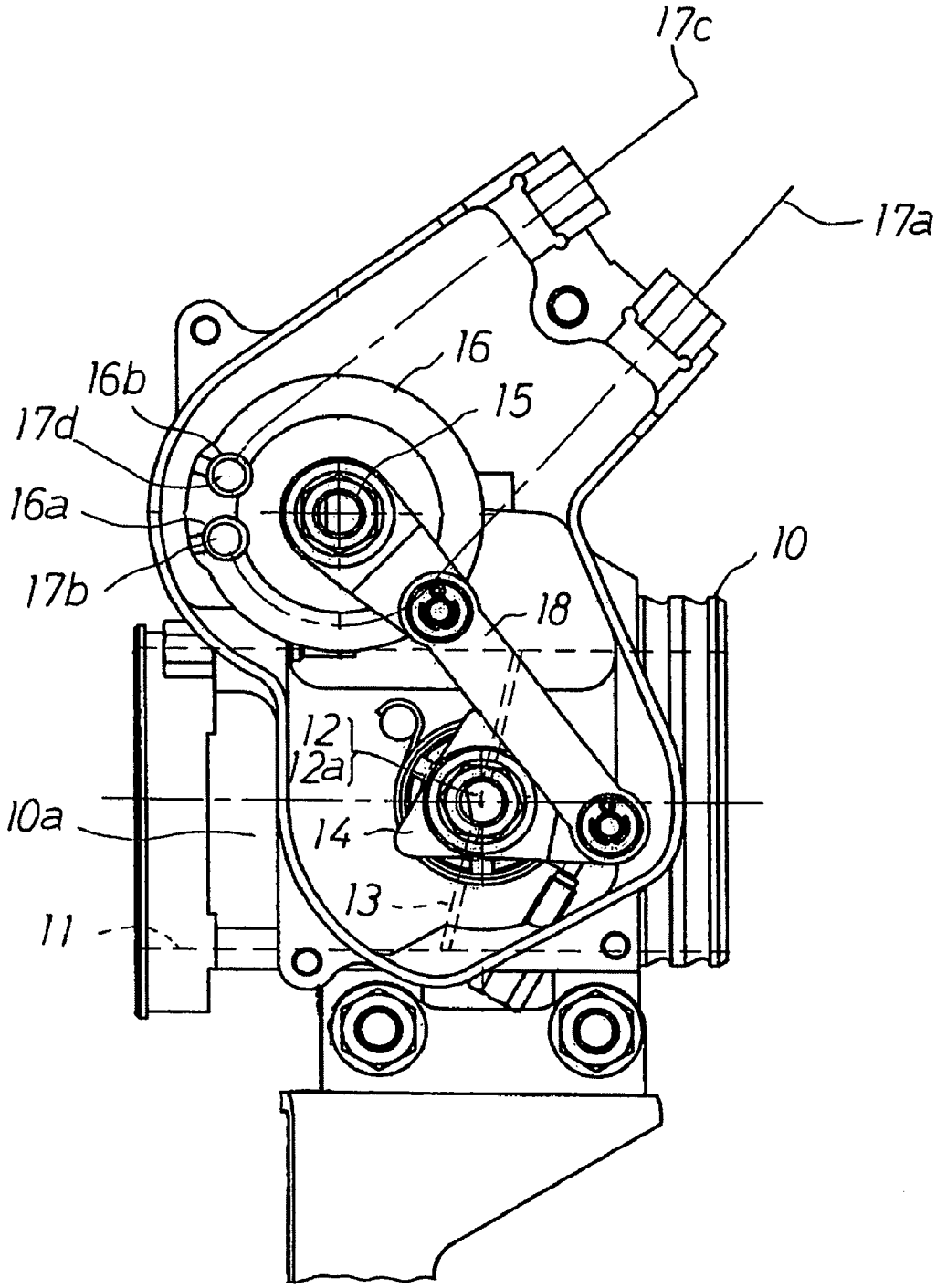
FIG. 5 is a right side view of FIG. 4.

In these Figures, like parts are identified by the same reference numerals as in FIG. 4 and the description thereof will be abbreviated.

The reference numeral 1 indicates a bypass air passage formed in another side outer wall 10*b* of a throttle body 10. In FIG. 3, a right end of the bypass air passage 1 opens at an intake passage 11*a* located in the upstream side of a throttle valve 13, while a left end thereof opens at an intake passage 11*b* located in the downstream side of the throttle valve 13.

Further, the reference numeral 2 indicates an air valve guiding cylinder formed in the other side outer wall 10*b* of the throttle body 10 so as to be opened toward the upper direction from the bypass air passage 1. Namely, the bypass air passage 1 is provided to be opened at the side wall of the air valve guiding cylinder 2.

The reference numeral 3 indicates an air valve disposed movably in the air valve guiding cylinder 2. This air valve 3 controls opening of the bypass air passage 1 which is opened at the air valve guiding cylinder 2, in other words, the air valve 3 controls the bypass air flow rate into the intake passage 11*b* of the downstream side. One end 4*a* of an initial operating wire 4 is retained on the air valve 3.

The initial operating wire 4 is drawn out through a cable holder 5, and connected at another end to a start lever (not shown) provided near an acceleration grip.

The initial operating wire 4 and an accelerator wires 17*a*, 17*c* for the opening or closing of the throttle valve are arranged so that the operating directions of the wires are brought to be substantially the same.

Figure 3:
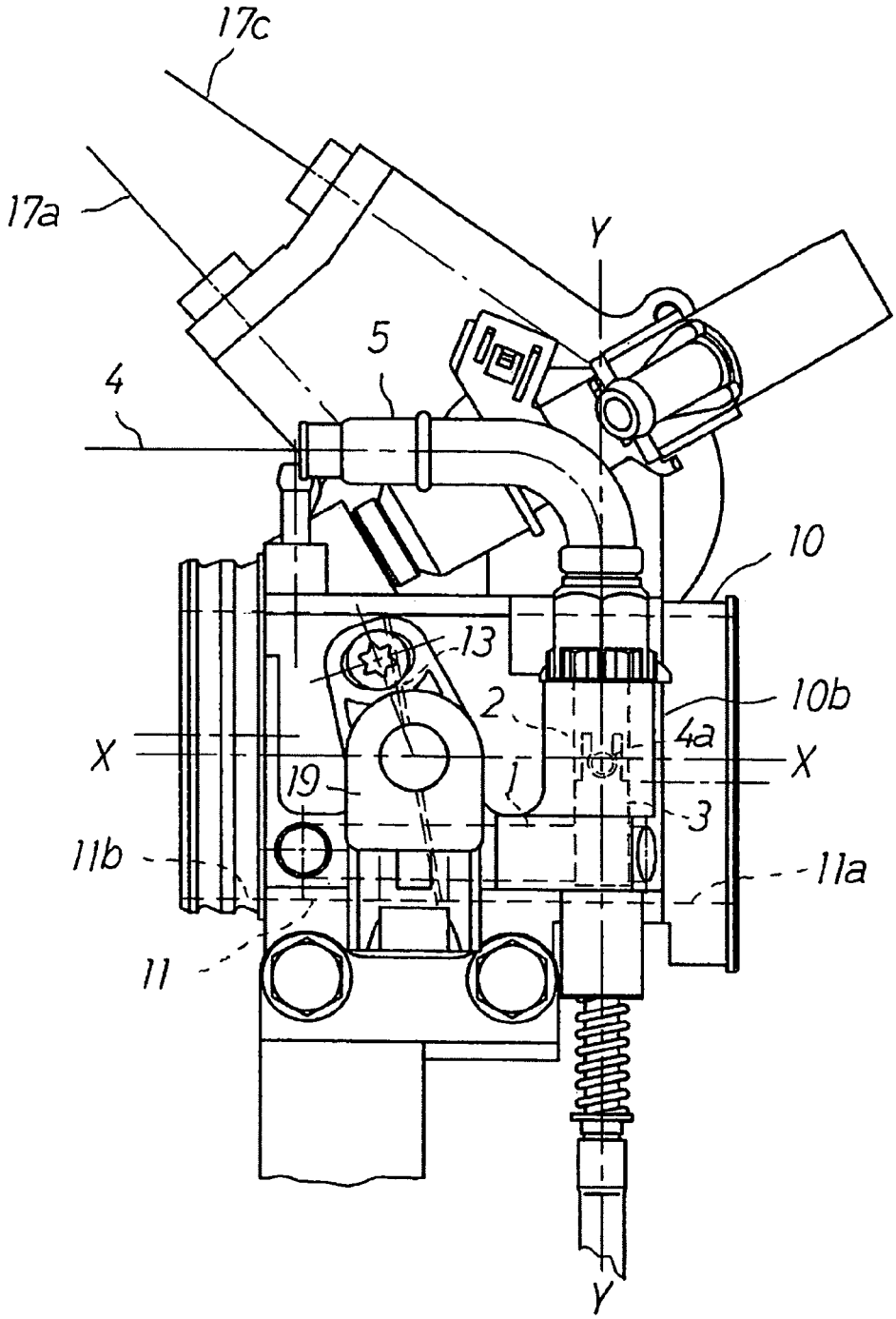
FIG. 3 is a left side view of FIG. 1.

In this embodiment, the initial operating wire 4 and the accelerator wires 17*a*, 17*c* are drawn out, as shown in FIG. 3, above the longitudinal axis X-X of the intake passage 11 and leftward from the longitudinal axis Y-Y of the air valve guiding cylinder 2.

With such throttle control apparatus, when the acceleration grip is operated by a driver, the rotation of the grip is transmitted to a throttle lever 16 through the valve-opening accelerator wire 17*a* or valve-closing accelerator wire 17*c*, and the rotation of the throttle lever 16 is transmitted to a drive lever 14 by means of a link lever 18 to rotate the drive lever 14 in response to the operation of the acceleration grip.

Therefore, the throttle valve 13 mounted on a throttle valve shaft 12 is rotated with the rotation of the drive lever 14 to open or close the intake passage 11 in response to the operation of the acceleration grip.

On the other hand, when the start lever is operated by the driver, the initial operation wire 4 is drawn to lift the air valve 3 in response to the movement or operation of the start lever, thereby the bypass air passage 1 is opened to supply, for example, an air flow required for the starting operation, in response to the opening of the air valve 3, toward the intake passage 11*b* of the downstream side.

According to the throttle control apparatus of the present invention, the accelerator wire 17*a* for the opening and the accelerator wire 17*c* for the closing for operating the throttle lever 16 are arranged along one side outer wall 10*a* of the throttle body 10, while the initial operation wire 4 is disposed along the other side outer wall 10*b* of the throttle body 10. Thus, the accelerator wires 17*a* and 17*c* and the initial operation wire 4 are brought to be located at opposite sides of the intake passage 11, thereby the mutual interference of the wires can be avoided.

Further, according to the throttle control apparatus of the present invention, since the operational directions of the accelerator wires 17*a* and 17*c* and the initial operation wire 4 are set to the area, for example, above the longitudinal axis X-X of the intake passage 11 and leftward from the longitudinal axis Y-Y of the air valve guiding cylinder 2, working of the connection between the accelerator wires 17*a* and 17*c* and the throttle lever 16, and the working of connection between the initial operation wire 4 and the air valve 3 can be done efficiently from substantially the same direction, resulting in the improvement of workability for the connection.

Further, according to the present invention, by arranging the bypass air control apparatus comprising the air valve guiding cylinder 2 including the bypass air passage 1 and air valve 3 on the other side outer wall 10*b*, the bypass air control apparatus can be positioned in close vicinity to the throttle body 10, thereby the throttle control apparatus can be made compact.

The reason that the throttle control apparatus can be made compact by the provision of the bypass air control apparatus on the other side outer wall 10*b* of the of the throttle body 10 is that only the throttle opening sensor 19 in a relatively smaller size is arranged on the other side outer wall 10*b* of the throttle body 10, but other components or members in relatively larger size need not be arranged on the other side outer wall 10*b* of the throttle body 10.

In addition, the following effects and advantages (a)~(c) are more effective for the motorcycle wherein the throttle control apparatus is accommodated in an extremely limited narrow space defined under a driver's seat or a fuel tank and sideward an engine.

(a) The accelerator wires 17*a* and 17*c* and the initial operation wire 4 can be arranged without mutual interference.

(b) Workability for the connection of wires can be improved.

(c) The throttle control apparatus can be made compact.

Furthermore, the throttle lever 16 may be mounted directly to one end 12*a* of the throttle shaft 12, and the same effects and advantages can be achieved as the above-mentioned embodiment.

What is claimed is:

1. A throttle control apparatus for a motorcycle comprising:

a throttle body having an intake passage extending through therein;

a throttle valve shaft supported rotatably in the throttle body across the intake passage, a throttle valve mounted on the throttle valve shaft for opening or closing the intake passage;

a drive lever mounted on one end of the throttle valve shaft;

a throttle opening sensor mounted on another end of the throttle shaft;

the one end of the throttle valve shaft being protruded from one side outer wall of the throttle body, while the other end of the throttle shaft being protruded from another side outer wall of the throttle body;

the rotation of a throttle lever operated with accelerator wires being transmitted to the drive lever through a link lever;

wherein a bypass air passage is provided on the other side outer wall of the throttle body so as to detour the throttle valve to make the intake passage communicated, an air valve is provided in the bypass air passage to open or close the bypass air passage by the operation of an initial operation wire and said accelerator wires and the initial operation wire are arranged at opposite sides of the intake passage respectively, so that the operating directions thereof are substantially the same to one another.

* * * * *